US005971302A

United States Patent [19]

Doumet

[11] Patent Number: 5,971,302

[45] Date of Patent: Oct. 26, 1999

[54] METHOD AND APPARATUS FOR DRYING AND GRINDING MOIST MATERIAL

[76] Inventor: Joseph E. Doumet, 1, Rue Jacob, 75006 Paris, France

[21] Appl. No.: 08/936,989

[22] Filed: Sep. 25, 1997

[30] Foreign Application Priority Data

Nov. 15, 1996 [EP] European Pat. Off. ..... 96118397

[51] Int. Cl.[6] ..... B02C 4/02; B02C 23/24

[52] U.S. Cl. ..... 241/17; 241/18; 241/23; 241/24.1; 241/27; 241/48; 241/52; 241/65; 241/79.1; 241/119

[58] Field of Search ..... 241/17, 48, 52, 241/65, 79.1, 117, 62, 119, 18, 19, 23, 24.1, 27

[56] References Cited

U.S. PATENT DOCUMENTS

| | | | |
|---|---|---|---|
| 1,702,333 | 2/1929 | Barthelmess | 241/17 |
| 3,078,048 | 2/1963 | Russell et al. | 241/17 |
| 3,784,115 | 1/1974 | Krijger et al. | 241/30 |
| 3,794,251 | 2/1974 | Williams | 241/65 |
| 3,951,347 | 4/1976 | Tiggesbaumker et al. | 241/52 |
| 5,180,113 | 1/1993 | Gehrike | 241/79.1 |
| 5,251,383 | 10/1993 | Williams | 34/12 |
| 5,381,968 | 1/1995 | Lohnherr et al. | 241/19 |

FOREIGN PATENT DOCUMENTS

| | | | |
|---|---|---|---|
| 1660738 | 7/1991 | Russian Federation | 241/62 |

OTHER PUBLICATIONS

Cement–Data–Book, pp. 235 to 241 pub. 1985.

*Primary Examiner*—John M. Husar
*Attorney, Agent, or Firm*—Reising, Ethington, Barnes, Kisselle, Learman, & McCulloch, P.C.

[57] ABSTRACT

Apparatus and method for drying and grinding moist raw cement or other material wherein the moist material is introduced to a grinding zone at which it is ground to produce relatively fine and relatively coarse particles which are separated and delivered to separate outlets. Hot drying gas is delivered to the path of fresh material flowing to the grinding zone to pre-dry such material, and the ground particles flowing to the respective discharge outlets are further dried by hot gas. The further dried relatively coarse particles are delivered the fresh material inlet and mixed with fresh material therein.

13 Claims, 1 Drawing Sheet

METHOD AND APPARATUS FOR DRYING AND GRINDING MOIST MATERIAL

Figure 1:
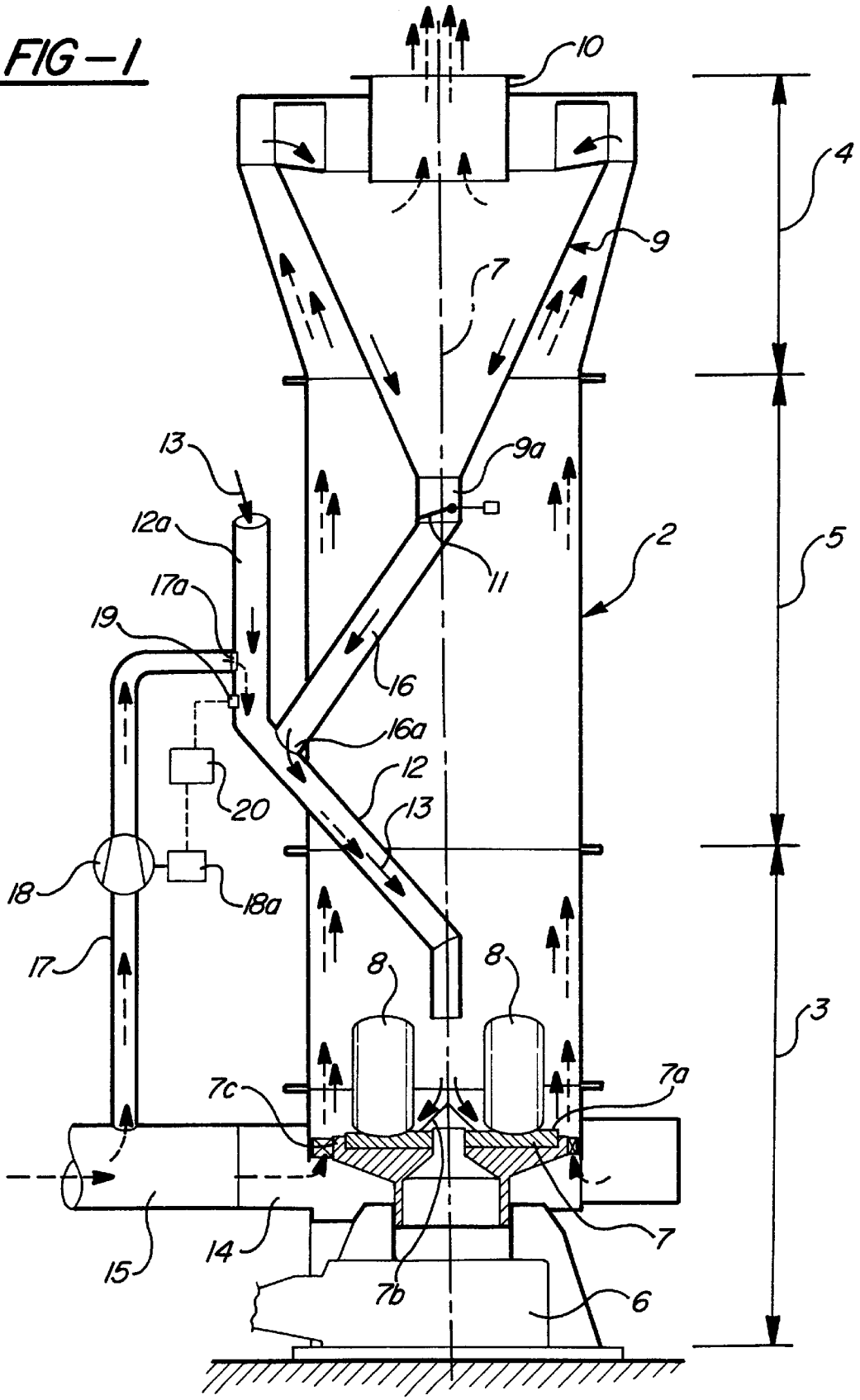

The invention relates to a method and apparatus for drying and grinding moist feed material, particularly moist cement raw material.

BACKGROUND OF THE INVENTION

Methods and apparatus for drying an grinding moist feed materials are known in many different forms, such as can be seen for example from W. H. Duda, CEMENT-DATA-BOOK, Volume 1, third edition, 1985, for instance pages 235 to 241. Roll mills typically used for this drying and grinding are constructed with a mill housing having a substantially vertical axis. In this mill housing a mill part (grinding part) is disposed in the lower part for the material comminution and an air separator is disposed in the upper part. The mill part contains a drivable and rotatable grinding table and a plurality of grinding rolls which roll thereon. Moist fresh feed material is delivered to the grinding table approximately in the centre, so that it is comminuted between the upper grinding surface of the grinding table and the grinding rolls. At least a proportion of the comminuted mill feed material is conveyed into the separator by a rising stream of hot gas delivered to the mill part, and is thereby dried. Sufficiently comminuted fine material is drawn off together with the hot gas stream from the air separator, whilst oversize material which is not yet sufficiently comminuted, so-called tailings, is returned to the grinding table in order to be further comminuted there.

In the practical use of the known methods and roll mills, difficulties always occur with the delivery of the moist feed material, involving amongst other things an unwanted incrustation of the fresh feed material in the region of the delivery arrangement.

The object of the invention is to provide an improved method and apparatus wherein by relatively simple means, even with relatively moist fresh feed material, it is always possible to ensure a reliable delivery of fresh material to the grinding table of the mill part.

SUMMARY OF THE INVENTION

In the method according to the invention predrying of the moist feed material is carried out in the region of the fresh material inlet, whereby on the one hand hot gas is introduced in a controllable quantity into the fresh material inlet and on the other hand the tailings coming from the air separator and to be returned to the grinding table are initially mixed with the fresh feed material in the fresh material delivery arrangement, whereupon this predried mixture of fresh feed material and tailings from the separator is delivered to the grinding table. Thus with this procedure the moist feed material delivered to the fresh material inlet can be subjected to a first drying with the aid of a sufficient quantity of hot gas. This can be achieved on the one hand by a direct action of the delivered hot gas on the fresh feed material and one the other hand by the walls of the fresh material inlet which are heated by the through flow of hot gas, and this already leads overall to a very effective predrying of the fresh feed material. When the tailings coming from the air separator and to be returned to the grinding table are also admixed with this fresh feed material at a suitable point in the fresh material inlet, then the fact that these tailings have already been subjected to intensive drying (drying and grinding) whilst being conveyed from the mill part into the air separator and also within the air separator means that due to the admixture of these relatively dry tailings the moisture content of the mixture of fresh feed material and tailings from the separator can be further lowered. Thus these combined predrying measures are almost ideal prerequisites for, on the one hand, delivery to the roll mill of a feed material with a relatively high moisture content (e.g. up to 15% and more) and, on the other hand, ensuring with great reliability that incrustations of material in the region of the fresh material inlet can be avoided as far as possible or completely, so that an extremely reliable operating delivery of fresh material to the grinding table is achieved.

Although in many instances it may be sufficient to introduce only a proportion of the tailings coming from the air separator into the fresh material inlet, according to the invention it is generally preferred to introduce all of the tailings coming from the air separator into the fresh material inlet, which brings with it advantages both as regards the lowering of the mixed moisture content and also as regards construction (simplification of the conveying elements).

In this invention it is also regarded as advantageous if the tailings are conveyed in a free-flowing state from the air separator to the fresh material inlet and are continuously admixed with the fresh feed material outside the mill housing. This produces a relatively long mixing route for fresh feed material and tailings from the separator.

In a further advantageous embodiment of this method according to the invention the fresh feed material and the tailings coming from the separator are passed through the fresh material inlet in a free-flowing state to the grinding table. In this way the fresh material inlet can be kept relatively simple in structural terms, i.e. apparatus parts which have to be driven can be avoided.

In the roll mill constructed according to the invention the fresh material delivery arrangement is simultaneously constructed as a predrying arrangement in the region upstream of the grinding table, and this fresh material delivery arrangement has connected to it on the one hand a second hot gas duct for introducing hot gas which is controllable at least in quantity and on the other hand a tailings conveying duct coming directly from the tailings outlet of the air separator.

THE DRAWING

The invention will be explained in greater detail below with reference to the drawing in which—in the single FIGURE—a preferred embodiment of the roll mill according to the invention is illustrated in a vertical section which has been kept largely schematic.

THE PREFERRED EMBODIMENTS

Since the basic construction of a roll mill is generally known to the person skilled in the art, it is quite sufficient in the present context to show only the parts of the apparatus which are necessary for explanation of the invention.

The roll mill according to the invention is constructed for drying and grinding of moist feed material, particularly moist cement raw material, but also for other moist feed materials, such as for example rough coal or the like.

This roll mill is constructed with a vertical axis (mill axis) 1 and comprises an outer mill housing 2 in which an actual mill part or grinding zone 3 is disposed—in the lower part—and an air separator zone 4 is disposed in the region above this mill part 3. A connecting intermediate part or zone 5 is also advantageously constructed or disposed in the region between the mill part 3 and the air separator zone 4.

Accordingly the mill part 3, the intermediate part 5 and the air separator 4 are disposed one above the other coaxially with respect to the mill axis 1.

The mill part 3 has, in a manner which is known per se, a grinding table 7 which can be driven rotatably by a suitable drive arrangement 6 and has an upper grinding track 7*a* on which grinding rolls 8 which are held so as to be stationary and rotatably roll. The grinding of the feed material produces relatively fine particles and relatively coarse particles or tailings as is conventional.

The air separator 4 can be constructed in any suitable form, i.e. as a so-called dynamic separator (with built-in rotor) or—as illustrated in the drawing—as a static air separator. This air separator 4 contains a collecting hopper 9 for oversize material or tailings with a tailings discharge outlet 9*a* at the lower end as well as an upper discharge connection 10 for drawing off hot gas charged with fine material. A dead-weight valve 11 can be disposed in the usual manner in the tailings outlet 9*a*.

This roll mill also contains a fresh material delivery inlet duct 12 for delivering the moist fresh feed material along a path from a source indicated by the arrow 13 to the grinding table 7, over the centre thereof with the distributor cone 7*b*.

At the lower end of the mill part 3, and approximately in the region below and around the grinding table 7 is constructed a hot gas delivery housing 14 to which is connected a hot gas duct 15 coming from a suitable hot gas source. As is indicated in the drawing by broken arrows for hot gas and solid arrows for material, comminuted mill feed discharged from the outer rim 7*c* of the grinding table is conveyed into the air separator 4 by the rising hot gas stream delivered by way of this hot gas duct 15, and in the air separator the comminuted mill feed is separated into fines and tailings, the mill feed being dried by the hot gas. The fines are discharged from the roll mill through the discharge connection 10 together with the hot gas stream which is flowing out, whilst the tailings from the tailings outlet 9*a* of the air separator 4 are returned to the grinding table 7. The latter does not occur directly, however, in the case of the roll mill according to the invention, but rather the tailings separated off in the air separator 4 are first of all introduced from the tailings outlet 9*a* by way of a tailings conveying duct 16 into the fresh material delivery duct 12 in which they are admixed from the fresh feed material before the feed material and tailings are then delivered jointly to the grinding table 7.

Apart from the tailings conveying duct 16 there is also a second hot gas duct 17 connected to this fresh air delivery arrangement 12 in order to introduce hot gas at least in a controllable quantity into this fresh material delivery inlet 12.

It is regarded as particularly advantageous in construction terms if both the fresh material delivery inlet 12 and the tailings conveying duct 16 are of approximately chute-like construction with an inclination to the horizontal so that within the fresh material delivery inlet 12 and within the tailings duct 16 it can be ensured that the particular material conveyed therein flows along downwardly inclined paths freely by gravity.

The junction 16*a* of the tailings conveying duct 16 with the fresh material delivery inlet 12 is provided—when viewed in the material flow direction (arrow 13)—after the junction 17*a* with the second hot gas duct 17. This junction 17*a* of the second hot gas duct 17 is advantageously located at the inlet end 12*a* of the fresh material delivery inlet 12.

Due above all on the one hand to the second hot gas duct 17 connected there and on the other hand to the tailings conveying duct 16 also connected there, the fresh material delivery arrangement 12 is simultaneously constructed in the region before the grinding table 7 as a predrying arrangement for the moist fresh feed material (arrow 13).

Although the second hot gas duct 17 and the tailings conveying duct 16 can be connected to the fresh material delivery inlet duct 12 at any suitable point, i.e. both inside and outside the mill housing 2, it is generally preferred to connect these two ducts 16 and 17 to the fresh material delivery inlet duct 12 outside the mill housing 2.

The second hot gas duct 17 can come from any suitable hot gas or hot air source, e.g. a separate hot gas producer, or a kiln exit gas duct (for example from a burning plant for the production of cement and the like). The same also applies to the first hot gas duct 15 which leads directly into the mill part 3. In the illustrated embodiment it may be assumed that the second hot gas duct 17 is branched off from the first hot gas duct 15.

It is regarded as particularly advantageous to co-ordinate with the second hot gas duct 17 a hot gas blower 18 which can be installed at any suitable point in the hot gas duct 17 and can be controlled at least with regard to the quantity of hot gas it introduces into the fresh material delivery inlet duct 12. However, other possibilities are also advantageously provided here for controlling the pressure of the hot gas to be introduced into the region of the fresh material inlet end 12*a* of the fresh material delivery duct 12. For this purpose there is disposed in the region of this fresh material inlet end 12 a gas pressure gauge 19 which preferably continuously measures the air or gas pressure prevailing therein and supplies measurement signals to a control arrangement 20 which is also connected for control purposes to the hot gas blower 18 or to the drive motor 18*a* thereof. These control connections are constructed in such a way that the hot gas introduced into the fresh material delivery inlet 12—by way of the blower 18 and the second hot gas duct 17—can be controlled both with regard to its quantity and its pressure so that approximately a zero gas pressure can be set at or in the region of the fresh material inlet end 12*a*. These measures reliably prevent unwanted cold air or infiltrated air from entering the fresh material delivery inlet 12 or passing through this fresh material delivery inlet 12 into the interior of the roll mill and impairing the desired dry effect.

I claim:

1. A method of drying and grinding moist feed material comprising delivering fresh, moist feed material long a path in the presence of hot drying gas and through an inlet to a grinder, thereby pre-drying said material upstream of said inlet; grinding the pre-dried material to produce relatively fine and relatively coarse particles of said material; delivering the relatively fine and relatively coarse particles to separate discharge outlets; further drying the relatively fine and relatively coarse particles as such particles move toward the respective outlets; and introducing the further dried relatively coarse particles to said path upstream of said grinder.

2. The method according to claim 1 wherein the pre-drying of said material is effected by introducing hot gas to fresh material moving along said path.

3. The method according to claim 1 wherein said grinder is enclosed within a housing and wherein the pre-drying of said fresh feed material occurs outside said housing.

4. The method according to claim 3 wherein the introduction of the relatively coarse particles to said path occurs outside said housing.

5. The method according to claim 1 wherein the relatively coarse further dried particles are delivered to said path in a free flowing state and wherein the combined fresh material and relatively coarse further dried particles are delivered to said grinder in a free flowing state.

6. The method according to claim 1 including maintaining the flow of drying gas in said inlet in such manner that substantially zero gas pressure exists in said inlet.

7. Apparatus for drying and grinding moist feed material comprising a housing; means forming a grinding zone in said housing; a source of fresh, moist feed material; inlet means for delivering fresh feed material from said source to said grinding zone; means at said grinding zone for grinding the material delivered thereto and producing relatively fine particles and relatively coarse particles; separator means in said housing for transferring the relatively fine and relatively coarse particles to separate discharge outlets; duct means for delivering relatively coarse particles from the coarse particles discharge outlet to said inlet means upstream from said grinding zone for mixing said relatively coarse particles with fresh material in said inlet means; means for delivering hot gas into said inlet means upstream from said grinding zone for pre-drying fresh material prior to grinding thereof; and means for delivering hot gas to said separator means for drying said relatively fine and relatively coarse particles.

8. Apparatus according to claim 7 wherein said duct means is coupled to said inlet means upstream from said grinding zone and downstream from the means for delivering said hot gas to said inlet means.

9. Apparatus according to claim 7 wherein said grinding means comprises a vertical roll grinder.

10. Apparatus according to claim 7 including control means for controlling the flow of hot gas into said inlet means such that a substantially zero gas pressure exists in said inlet means.

11. Apparatus according to claim 7 wherein said inlet means and said duct means are inclined to enable contents thereof to flow freely by gravity.

12. Apparatus according to claim 7 wherein said inlet means and said duct means communicate externally of said housing.

13. A method of drying and grinding moist feed material comprising delivering fresh, moist feed material along a path in the presence of hot drying gas and through an inlet to a grinder, thereby pre-drying said material upstream of said grinder; grinding the pre-dried material to produce relatively fine and relatively coarse particles of said material; delivering the relatively fine and relatively coarse particles to separate discharge outlets; further drying the relatively fine and relatively coarse particles as such particles move toward the respective outlets; introducing the further dried relatively coarse particles to said path upstream of said grinder; and introducing the hot drying gas to said fresh material upstream from the introduction of the relatively coarse particles to said path.

* * * * *

UNITED STATES PATENT AND TRADEMARK OFFICE

CERTIFICATE OF CORRECTION

PATENT NO. : 5,971,302

DATED : October 26, 1999

INVENTOR(S) : Joseph E. Doumet

It is certified that error appears in the above-indentified patent and that said Letters Patent is hereby corrected as shown below:

Column 3, line 43, change "from" to --with--

Signed and Sealed this

Sixteenth Day of May, 2000

*Attest:*

*Attesting Officer*

Q. TODD DICKINSON

*Director of Patents and Trademarks*